US005200562A

United States Patent [19]

Kaneko et al.

[11] Patent Number: 5,200,562

[45] Date of Patent: Apr. 6, 1993

[54] KEY POSITION COMPUTING APPARATUS AND COMPUTING METHOD THEREFOR

[75] Inventors: Makoto Kaneko; Ichirou Ohe, both of Hamamatsu, Japan

[73] Assignee: Yamaha Corporation, Hamamatsu, Japan

[21] Appl. No.: 781,727

[22] Filed: Oct. 23, 1991

Related U.S. Application Data

[63] Continuation-in-part of Ser. No. 647,440, Jan. 29, 1991, abandoned.

[30] Foreign Application Priority Data

Jan. 30, 1990 [JP] Japan ..... 2-20030

[51] Int. Cl.[5] ..... G10F 1/02

[52] U.S. Cl. ..... 84/21; 84/626; 84/DIG. 7

[58] Field of Search ..... 84/20, 21, 626, 687, 84/DIG. 7, 22

[56] References Cited

U.S. PATENT DOCUMENTS 4,351,221 9/1982 Starnes et al. ..... 84/21 X
4,468,999 9/1984 Bonanno ..... 84/DIG. 7
4,790,230 12/1988 Sanderson ..... 84/687
4,913,026 4/1990 Kaneko ..... 84/21
4,970,928 11/1990 Tamaki ..... 84/21

*Primary Examiner*—Donald A. Griffin
*Assistant Examiner*—Jae N. Noh
*Attorney, Agent, or Firm*—Spensley Horn Jubas & Lubitz

[57] ABSTRACT

A key position computing apparatus for a player piano is presented which includes the following components (a) sensing device provided on each key and adapted for measuring a distance between a reference plane and a key surface for each key, (b) memory device for storing computer programs to compute the relationship between the output from the sensing device and the distance between the reference plane and the key surface, (c) programmable memory device for storing the characteristic operating data of the sensing device for each key, (d) computing device for computing the relationship between the output from the sensing device and the distance from the reference plane to the surface of each key, (e) gain adjusting device for adjusting the gain of the output from the sensing device to a constant value, and (f) linearizing device for approximating the output of the sensing device by a linearized signal. The player piano, so equipped and operated according to the steps, produces continual monitoring and real time dynamic reproduction of a musical performance.

20 Claims, 8 Drawing Sheets

KEY POSITION COMPUTING APPARATUS AND COMPUTING METHOD THEREFOR

This is a continuation in part application of the U.S. patent application U.S. Ser. No 07/647,440 filed Jan. 29, 1991, now abandoned.

FIELD OF THE INVENTION

This invention relates to a key position computing apparatus for a player piano to continually and accurately follow and reproduce the performance style on a real time basis.

BACKGROUND ART

A player piano, or automatic performance piano, has two functioning modes: in the recording mode the piano records a music being played by a person while in the playing mode, the piano either plays a prerecorded music or is driven by some external musical signals. In the recording mode, it is necessary to sense the changing position of the keys being played and to convert this information into electrical recording signals. FIG. 14 shows a conventional mechanism for providing this type of sensing action. The player piano 71 in this figure consists of a key board having a number of keys 73, a striking mechanism 77, the hammer head 75, the string 79 and a damper head 78.

Each of the keys 73 is supported at the balancing fulcrum 81, and when either the key 73 is manually pressed down or a solenoid 83 causes the plunger to push up the key 73, this key motion is transmitted to the hammer head 75 and the damper head 78 through the striking mechanism 77, resulting in the hammer head 75 striking the string 79 as the damper head 78 leaves the string 79.

Each key 73 is provided with a shutter 87, on its bottom side, to act on a light beam in combination with a transmission-type photo-interrupter 89. The output from this photo-interrupter 89 is forwarded to a controller 85 which is programmed to recognize the position of the key 73.

In the playing mode, to reproduce the performance style it is not sufficient simply to sense the static position of the key 73, whether the key is in the resting position or in the extreme down stroke position. Such performance data must be translated in terms of the duration and velocity of a key stroke. However, in the conventional player piano 71 described above, it was not possible to obtain such performance-style data, because of the inherently limited ability of the combined photo-interrupter 89 and shutter 87 mechanism, which can only detect the static position information of the key 73 and not the dynamic, time-dependent information of the key movement. A solution to this problem, for example, may be to provide each key with multiple shutters to detect progressive changes in the key position, but such a method would encounter basic difficulties of maintaining accuracy and long-term reliability of a multiple-sensor mechanism. Furthermore, such a mechanism presents production difficulties due to the fact that multiple shutters 87 must be installed on the bottom side of each key 73, making not only the installation but also the inspection procedures complex and time-consuming.

SUMMARY OF THE DISCLOSURE

An objective of an embodiment of the present invention is to present a key position computing apparatus for a player piano, which can continually and accurately provide not only the static positional information but also the dynamic positional information to reflect the style of the performance. The position computing apparatus is provided with the following components:

(a) sensing device provided on each key and adapted for measuring a distance between a reference plane and a key surface for each key, (b) memory device for storing computer programs to compute the relationship between the output from the sensing device and the distance between the reference plane and the key surface, (c) programmable memory device for storing the characteristic operating data of the sensing device for each key, (d computing device for computing the relationship between the output from the sensing device and the distance from the reference plane to the surface of each key, (e) gain adjusting device for adjusting the gain of the output from the sensing device to a constant value, (f) linearizing device for approximating the output of the sensing device by a linearized signal.

According to such an apparatus, it becomes possible to automatically adjust the gain of all the reflecting type photo-interruptor (RPI) 1 provided for each key of the eighty eight keys 73, thereby increasing the efficiency of gain setting operation. Further, it is possible to perform continuous detection of the position of the key 73 with a simple construction consisting of devices such as the RPI 1, variable gain amplification circuit 4, hereinafter referred to as voltage controlled amplification (VCA 4), as a gain setting method and a microcomputer 10. Even when the reference position for the positional change is not known for certain, so long as the value of the stroke, which is a measure of the relative movement of the key 73, is known, it is possible to correct the gain of each RPI 1 so as to determine the changing position of the keys 73. These features of an embodiment of the present invention combine to produce a overall effect of continual monitoring and real time dynamic reproduction of a musical performance.

PREFERRED EMBODIMENTS OF THE PRESENT DISCLOSURE

Figure 1:
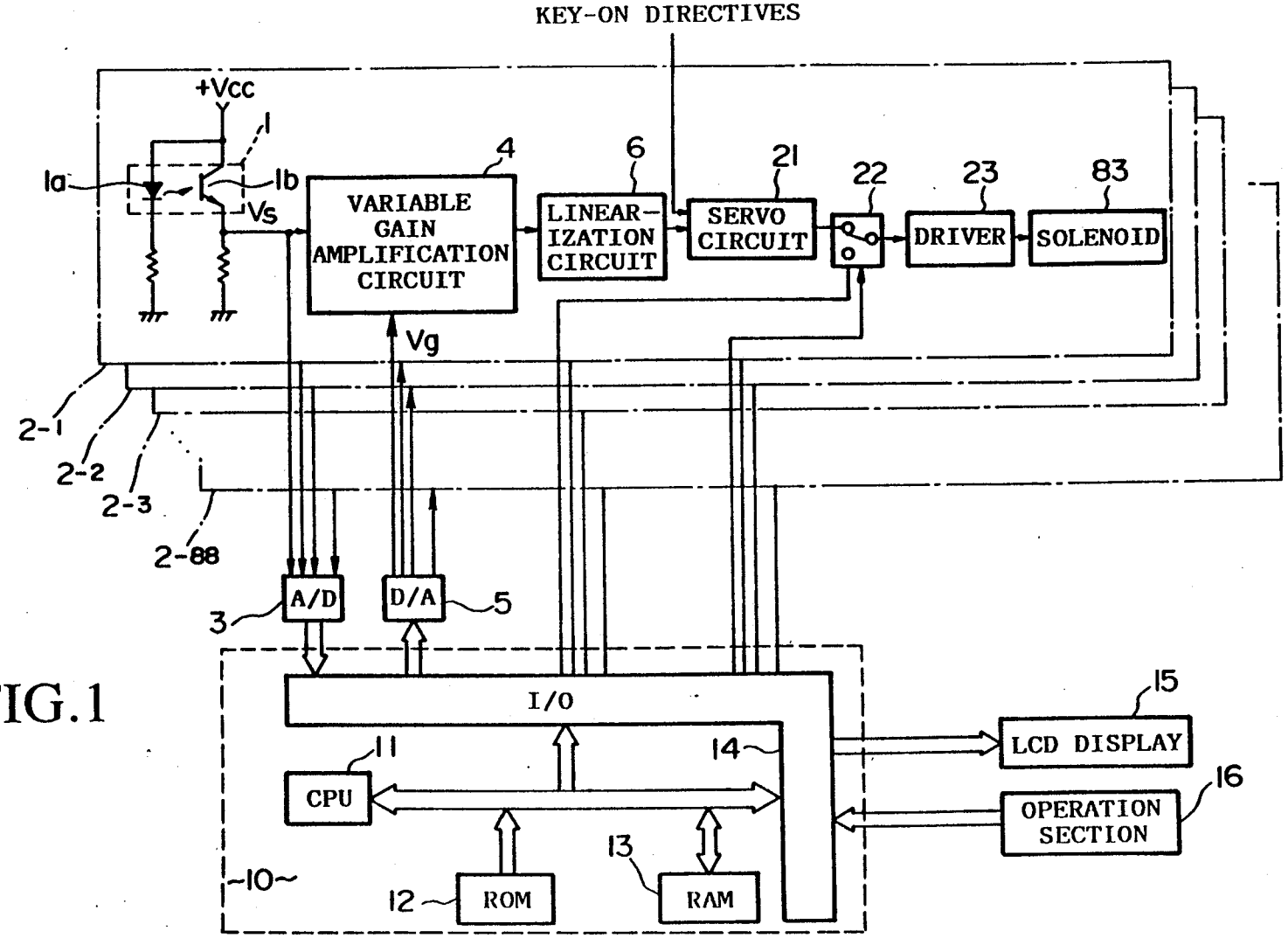
FIG. 1 is a block diagram for a first preferred embodiment.
Figure 2:
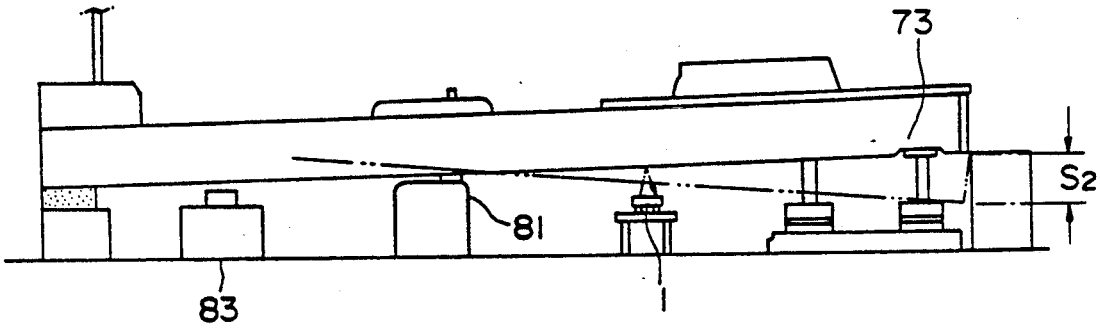
FIG. 2 shows the structural details of a key 73 of the first embodiment schematically.

The electrical layout of a first embodiment is shown schematically in FIG. 1. The numeral 1 indicates a reflective type photo-interruptor which is disposed o each of the eighty eight keys 73, which is an encased unitized device consisting essentially of a light source 1*a* to shine a beam of light onto the bottom surface of the key 73 and a light sensor 1*b*. This reflective type photo-interruptor 1 is disposed on the bottom surface of each of the keys 73 as shown in FIG. 2, and each key 73 is provided with a feedback control circuit $2_1 \sim 2_{88}$ shown in FIG. 1, to correspond with eighty eight keys 73.

Figure 3:
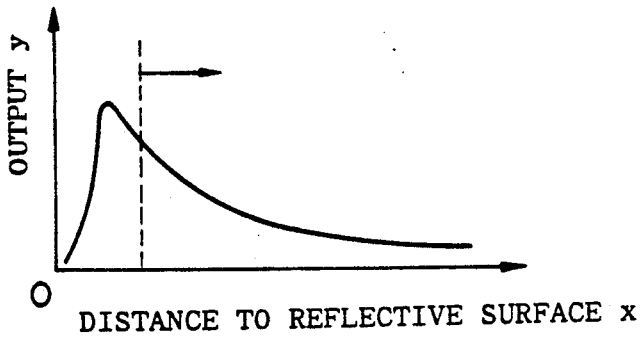
FIG. 3 shows the output characteristics of a reflecting type photo-interruptor 1.

The output signal Vs from the reflecting type photo-interruptor (hereinafter referred to as RPI) 1 in the feedback control circuit $2_1 \sim 2_{88}$ is supplied to an A/D feedback (analogue to digital) converter 3 and to a VCA circuit 4. This VCA circuit 4 amplifies the output signal Vs in accordance with the value of the gain setting voltage supplied from the D/A converter 5, and supplies it to a linearizing circuit 6. The linearizing circuit 6 transforms output signal of the type shown in FIG. 3, showing the output voltage y as a function of the distance between the RPI 1 and the keys 73, into a linearized signal, which is then supplied to a servo circuit 21. This servo circuit 21 generates control signals so as to make the value of the feedback signal from the linearizing circuit 6 identical with the value of a key-on command signal from the microcomputer (not shown) used for key drive control. This control signal is supplied to the driver 23, through an analogue switch 22, which drives a solenoid 83.

The A/D converter 3 and the D/A converter 5 are connected with the I/O (input/output) circuit 14 of a microcomputer 10. This microcomputer 10 comprises: a CPU 11 to control the operations of the various components; a ROM (read only memory) 12 which stores the programs for the microcomputer 10; a RAM (random access memory) 13 which stores temporary data during the execution of the program; and an I/O circuit 14 which interfaces with external data. The CPU 11 performs the program steps in accordance with the operational instructions from the operator section 16, such as gain adjustment steps in the test mode program which is described later, as well as controls the display functions of the data required by the performer on a LCD device 15. Further, during the execution of the gain adjustment program the CPU 11 performs switching of the analogue switches 2 provided on each key 73, and supplies control signals to the driver 23, through the various analogue switches 22, to drive the keys 73.

Now, the principle of the gain adjustment process of the RPI 1 will be explained.

First, in the relationship between the output voltage y of the RPI 1 and the distance x to the bottom surface of the key 73, shown in FIG. 3, the curve to the right of the dotted line ca be approximated by an equation:

$$y = A \cdot x^N \quad (1)$$

where N is a constant related to the characteristics of the RPI 1 and the reflectivity of the reflective surface of the key bottom surface; and A represents the gain of the RPI 1, which varies individually from key to key.

Figure 4:
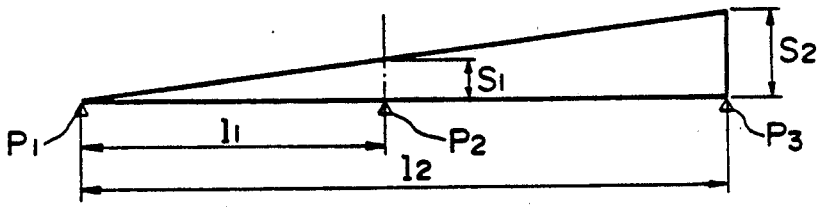
FIG. 4 illustrates the range of motion of the key 73 schematically.

FIG. 4 shows the stoke of the keys 73, which defines the range of motion of the keys 73 produced by key-pressing or key-releasing motion. In this figure, Pl is the key-rest position supported by the balance pin 81; P2 is the output portion having a RPI 1; P3 is the plane of the front edge of the 73. The stroke distance S2 of the front edge plane is typically set to be 10.0 mm at the time of piano tuning. Therefore, the distance S1 can be expressed by:

$$S_1 = 10.0 \cdot (1_1/1_2) \quad (2)$$

where $1_1$ is the distance between the positions P1 and P2 and $1_2$ is the distance between the positions P1 and P3.

In determing the position a key 73, although there is no absolute value for the standard position a key, because it is made of wood and is subject to changes induced by changes in temperature and humidity, it may be considered that the stroke S1 is fixed by the value of the distance calculated in the above equation (2).

With the key 73 fully depressed, let the distance $x_1$ be the distance between the RPI 1 and the reflective bottom surface of the key 73; and let $y_2$ be the corresponding output value from the RPI 1. When the key is fully released, the distance $x_2$ between the RPI 1 and the back surface of the key 73 becomes $(x_1+S_1)$, and combining with $y_2$, the following equation can be derived:

$$y_1 = A \cdot (x_1^N) \quad (3),$$

and $$y_2 = A \cdot (x_1 + S_1)^N \quad (4)$$

The equation (3) can be rewritten as:

$$x_1 = (y_1/A)^{1/N} \quad (5)$$

and substituting (5) into (4) gives;

$$y_2 = A \cdot \{(y_1/A)^{1/N} + S_1\}^N \quad (6)$$

and raising both sides to the power 1/N $$\begin{aligned} (y_2)^{1/N} &= (A^{1/N}) \cdot \{(y_1/A)^{1/N} + S_1\} \\ &= (y_1)^{1/N} + S_1 \cdot (A)^{1/N} \end{aligned} \quad (7)$$

is obtained.

Equation (7) can be rewritten as:

$$A^{1/N} = \frac{(y_2)^{1/N} - (y_1)^{1/N}}{S_1}$$

or, as $$A = \left[ \frac{\{(y_2)^{1/N} - (y_1)^{1/N}\}}{(S_1)} \right]^N. \quad (9)$$

As evident from this equation (9), even if the absolute positional value of $x_2$, defined by equation (12), cannot be known, if the value of stroke $S_1$ is known, it becomes possible to determine the gain A of the RPI 1.

In this case, if $A_0$ (a constant) is the target gain to be made the standard gain, by supplying a voltage Vg to correspond with the correction factor $A_0/A$ to the VCA circuit 4, it becomes possible to automatically adjust all the values of the gain, of the detection system including the VCA circuit 4, to be standardized with respect to $A_0$. The values of $y_1$, $y_2$ in the above equation (9) are determinable and S1 and N are constants.

It is now necessary to consider how the specific gain A of the RPI 1 might change with age after it has been set correctly. Possible reasons for change with age in the value of the gain in the above equation (1) may be: (a) changes in the reflective surface of the key 73, and/or (b) the performance characteristics of the light source 1*a* and/or the sensor 1*b* may change with age. When such changes do occur, it is necessary to readjust the gain. In such a case also, it is necessary to know the value of the stroke $S_1$ of the keys 73. In the case of a piano, after tuning is performed and the stroke adjusted, the gain is adjusted. So long as the gain A remains unchanged, the output of the linearizing circuit 6 should be proportional to the distance between the reflective surface and the RPI 1 to fully serve the purpose of a position detection device. That is to say, even if the relative positional relationship and the stroke distance are changed, the position detection system operates satisfactorily to provide the correct output data.

Next, the case of manual adjustment of the gain of the RPI 1 will be described.

In the above equation (4), by replacing $(x_1+S_1)$ with $x_2$;

$$y_2=A\cdot(x_2^N) \tag{10}$$

and solving for $x_2$, $$x_2=(y_2/A)^{1/N} \tag{11}$$

and substituting (9) into (11) gives $$x_2 = \left[\frac{y_2}{\frac{\{(y_2)^{1/N}-(y_1)^{1/N}\}^N}{(S_1)^N}}\right]^{1/N} = \frac{(y_2)^{1/N}\cdot S_1}{(y_2)^{1/N}-(y_1)^{1/N}} \tag{12}$$

If $A_0$ is the standard gain, and $y_2'$ is the output correction factor at a distance $x_2$, then $$y_2' = A_0\left[\frac{(y_2)^{1/N}\cdot S_1}{(y_2)^{1/N}-(y_1)^{1/N}}\right]^N = \frac{A_0\cdot S_1^N\cdot y_2}{\{(y_2)^{1-N}-(y_1)^{1/N}\}^N} \tag{14}$$

As evident from the above equation (14), if the values of the $y_1$ and $y_2$ are determined, the correction factor $y_2'$ for the distance $x_2$ can be obtained.

Figure 5:
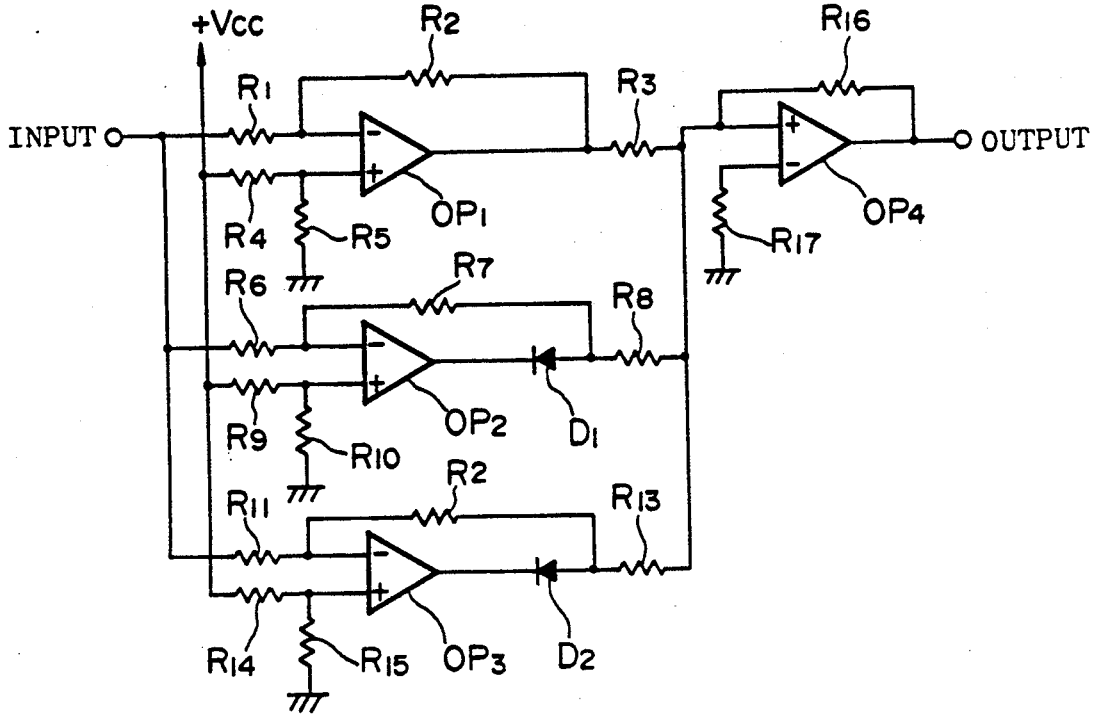
FIG. 5 is a circuit diagram for a linearizing circuit.
Figure 6:
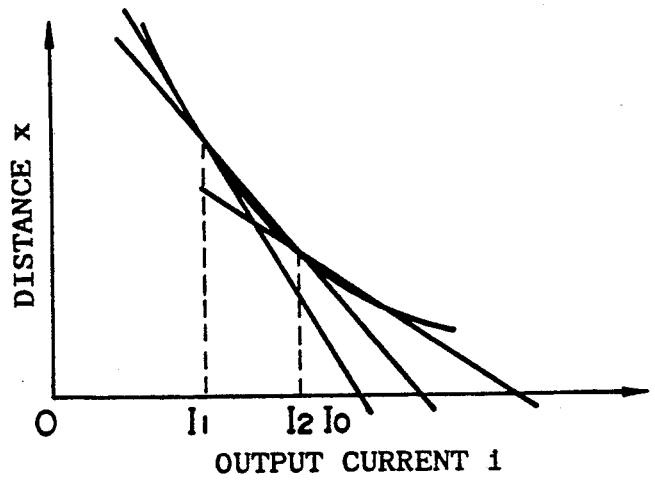
FIG. 6 illustrates a method of tangential approximation of the output curve of the reflecting type photo-interruptor 1.
Figure 7A:
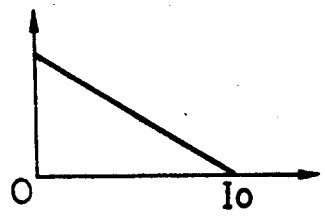
FIGS. 7(A)~(C) show the respective linearization of the three portions of the curve shown in FIG. 6.
Figure 7B:
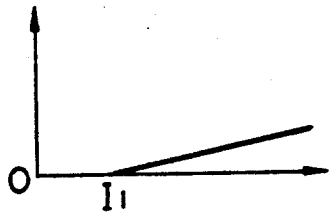
Figure 7C:
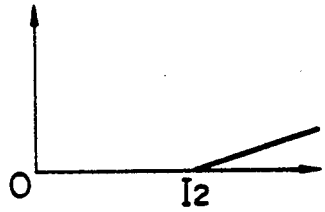

The circuit means to generate the linear output of the RPI 1 to correspond with the distance between the keys 73 and the RPI 1 can be, for example, a linearizing circuit 6, such as the one shown in FIG. 5, which consists of ideal diodes $D_1$, $D_2$, operational amplifiers (op amps) $OP_1 \sim OP_6$, and resistances $R_1 \sim R_{17}$. And if the relationship between the distance x and the output current i is a curve similar to the one shown in FIG. 6, it is possible to approximate the curve in terms of three straight lines shown in FIGS. 7A to 7C. By using such discrete lines approximation method, the amplification factors for the various components, such as the op amps $OP_1 \sim OP_6$, are determined by the following methodology.

Figure 8:
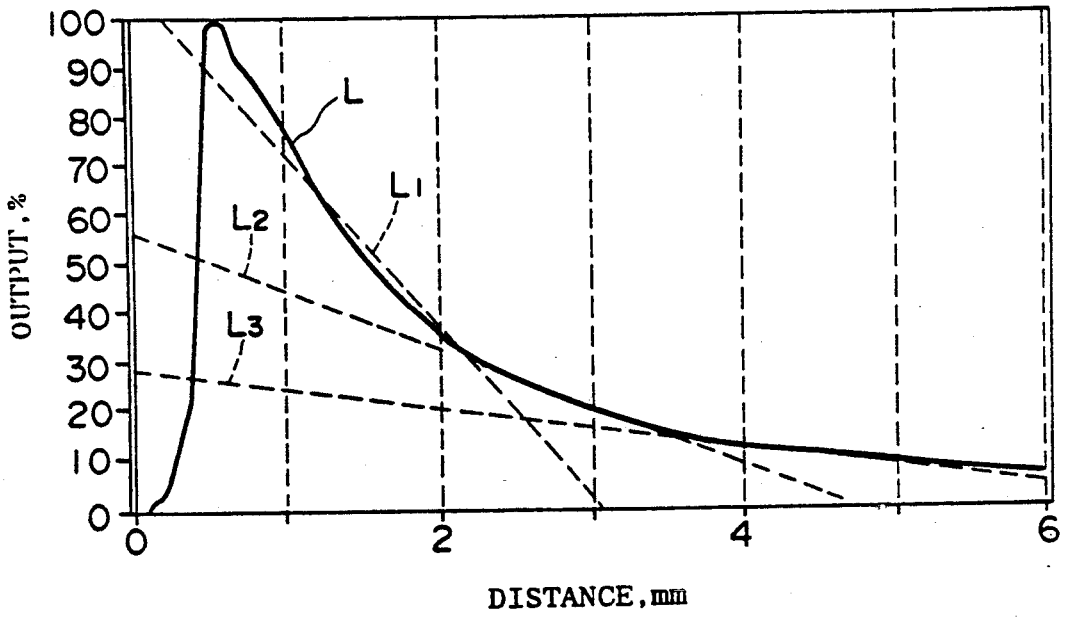
FIG. 8 shows the output characteristics of the reflecting type photo-interruptor and linear approximations of the curve.

First, along the curve L of the output power from the RPI 1 shown in FIG. 8, three line $L_1$, $L_2$ and $L_3$ are drawn so as not to exceed the maximum deviation of ±0.1 mm. The three lines $L_1$, $L_2$ and $L_3$ are expressed by the following equations:

$$d_1=-28.28\times10^{-3}\,i+3.05 \tag{15}$$

$$d_2=-83.68\times10^{-3}\,i+4.7 \tag{16}$$

$$d_3=-0.2465\,i+6.903 \tag{17}$$

Figure 9:
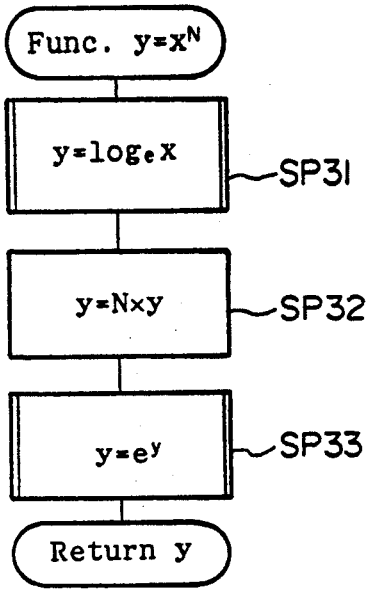
FIG. 9 shows the main routine of the linearization computer program.

The deviation of the lines $L_1$, $L_2$ and $L_3$ from the curve L are shown in FIG. 9. In this case, if the 100% output power from the RPI 1 is made to be 10 volts (i=10i') and the output power v is expressed by 1 mm/v, the above equations (15) to (17) become:

$$v_1=-28.28\times10^{-2}\,i+3.05 \tag{18}$$

$$v_2=-83.68\times10^{-2}\,i+4.7 \tag{19}$$

$$v_3=-2.465\,i+6.903 \tag{20}$$

Using a general equation form of the type:

$$y_1=-A_1x+B_1 \tag{21}$$

$$y_2=-A_2x+B_2 \tag{22}$$

$$y_3=-A_3x+B_3 \tag{23}$$

can be converted into the amplification equations in the discrete line approximation for each of the op amps using ideal diodes become as follows:

$$V_0=-A_1vi+B_1 \tag{24}$$

$$V_0=(A_1-A_2)\,vi-(B_1-B_2) \tag{25}$$

$$V_0=(A_2-A_3)\,vi-(B_2-B_3) \tag{26}$$

and substituting these equations (24) to (26) into equations (18) to (20) and transforming:

$$V_0=-2.465vi+6.903 \tag{27}$$

$$V_0=1.628vi-2.203 \tag{28}$$

$$V_0=0.554vi-1.65 \tag{29}$$

and further transformation produces:

$$V_0=1.381(1.785vi-5.000) \tag{30}$$

$$V_0=-0.4406(-3.818vi+5.000) \tag{31}$$

$$V_0=-0.3300(-1.679vi+5.000) \tag{32}$$

and the values for the various components in FIG. 5 are obtained on the basis of these equations (30) to (32).

The linearization operations can be carried out by using software programming. In calculating the equation $y=x^N$, and remembering that N is not an integer, the following calculation steps are performed, taking a natural logarithm of the expression:

$$y=x^N \quad (33)$$

results in, $$\ln(y) = \ln(x^N) = N \cdot \ln(x) \quad (34)$$

taking antilogarithms of equation (34) results in, $$y=e^{N \cdot ln(x)}.$$

Figure 11:
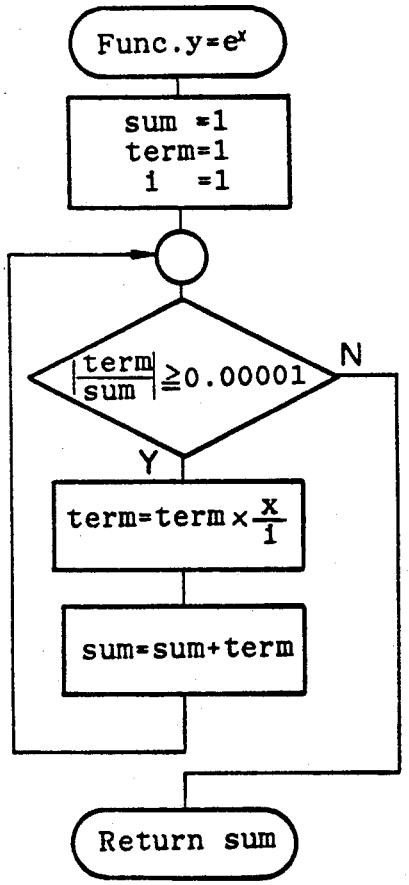
FIG. 11 is a flow chart showing an exponential computational process.
Figure 10:
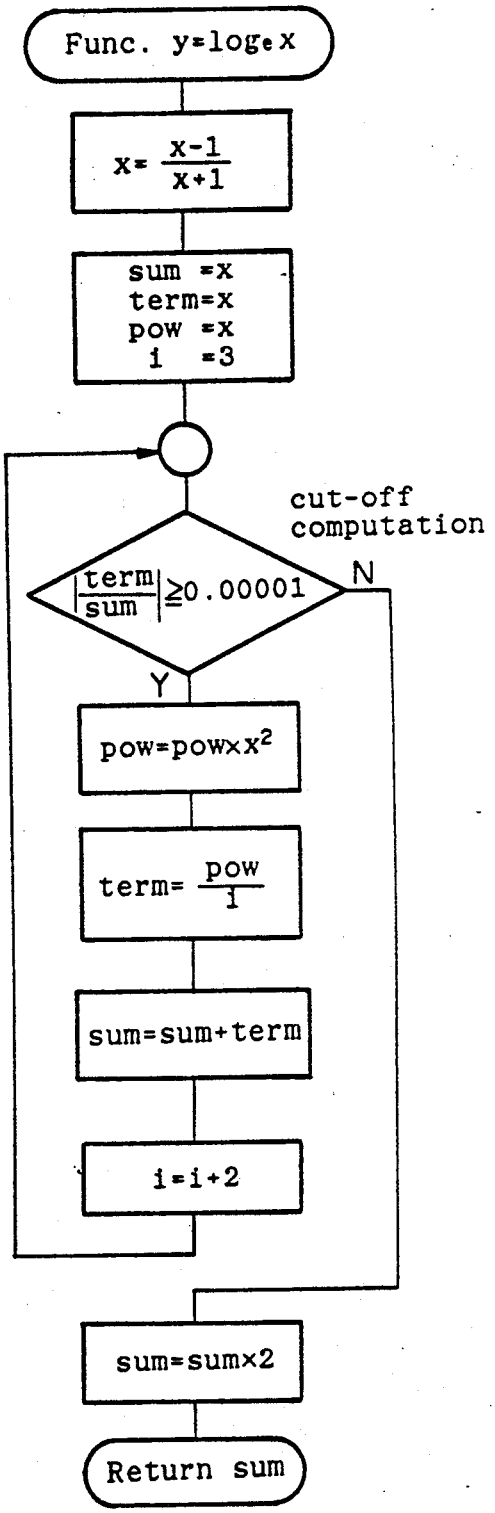
FIG. 10 shows a program routine of a logarithmic computational process.

The flow chart for the above computational steps is shown in FIGS. 9 to 11. FIG. 9 is the linearization main routine in which step SP31 calculates ln (x). In the step SP32, the result obtained in step SP31 is multiplied by N, and SP33, antilog operation is performed. FIG. 10 shows an example of computation in SP31 shown in FIG. 9. FIG. 11 shows an example of computational flow in SP33.

Next, the operational steps of a first embodiment will be explained with reference to FIG. 12.

Figure 12:
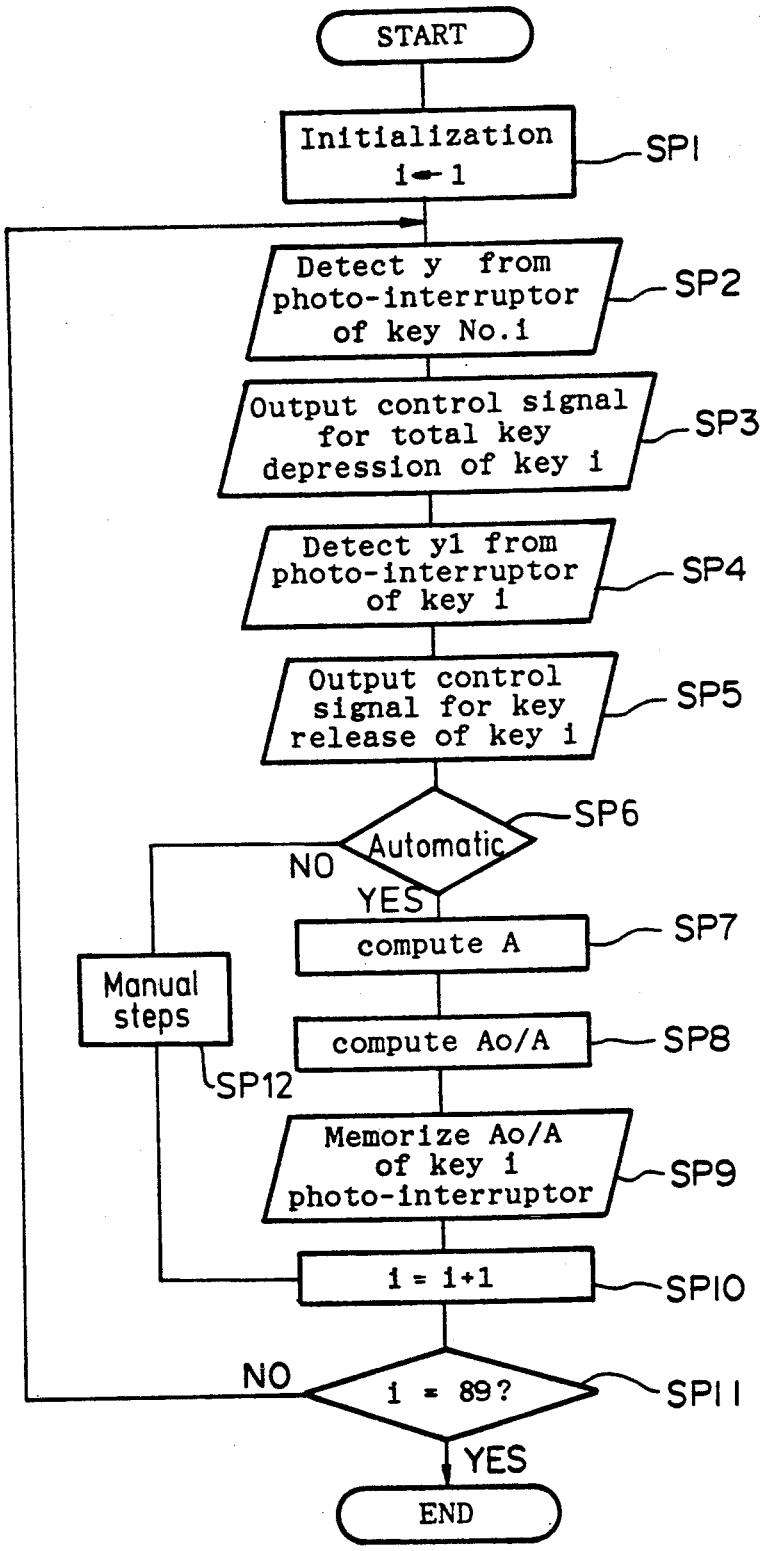
FIG. 12 is a flow chart for a test mode of the first embodiment.

When a performer selects the test mode by operating an appropriate mode selection switch provided in operation section 16 (refer to FIG. 12), CPU 11 follows the program steps shown in the flow chart in FIG. 12 to undertake the gain adjustment program.

First in SP1, CPU 11 performs the initialization step to set the key number i to 1, and issues a control signal to set all the keys in the key-release condition. CPU 11 switches on all the analogue switches 22 provided for each key 73, and issues a key-release signal, through the switch 22, to all the driver 23 provided for each key 73.

In SP2, for the key specified by a key number i of the keys 73, the value of the output signal Vs from the RPI 1 is obtained through the A/D converter 3 and is stored in a corresponding memory spot in RAM 13 as $y_2$.

In SP3, by activating the corresponding solenoid 83 for the specified key, the key is made to become fully depressed, i.e., the full stroke of the key is pushed in.

In SP4 as in SP2, the value of the output signal Vs from the corresponding RPI 1 is obtained through the A/D converter 3 and is stored in a corresponding memory location in RAM 13 as $y_1$.

In SP5, by deactivating the corresponding solenoid 83 for the specified key, the key is made to become fully released.

In SP6, it is decided whether the test mode is automatic or manual by means of the information provided by the mode selection switch in the operational section 16: and if it is the automatic mode, the step proceeds to SP7 while if it is the manual mode, it proceeds to SP10 after completing the steps for manual adjustment routine in SP12.

In SP7, substituting the values of $y_1$, $y_2$, and constants N and $S_1$ stored in RAM 13 in equation (9), the specific value of gain A associated with the specific RPI 1 is obtained.

In SP8, using the values of the standard gain $A_0$ (a constant) and the actual gain A, the gain correction factor $A_0/A$ to be applied to VCA circuit 4 is calculated for the key.

In SP9, the calculated value of $A_0/A$ is stored, as the value corresponding to the gain setting voltage Vg, in a specific memory location in RAM 13

In SP10, the key number i is incremented by one unit, the steps 2 to 11 are repeated until the key number i in step SP11 becomes i=88. By this process, the correction factors $A_0/A$ for the gain voltage Vg, for each of the RPI 1 for every one of the eighty eight keys 73, are obtained and stored in separate locations in RAM 13.

Henceforth, in the play mode to reproduce a performance, when the key i specified by a key-drive microcomputer (not shown) of the keys 73 is played, CPU 11, activated by the command signal from the key-drive microcomputer, sets the gain setting voltage Vg to be applied to the VCA circuit 4 according to the correction factor $A_0/A$. As a result, the output signal Vs from each of the RPI 1 becomes amplified according to the correction factor $A_0/A$, thereby producing automatic adjustments of all the gains of the detection system, including the VCA circuit 4, to be adjusted according to the standard gain $A_0$.

According to the embodiment presented above, by selecting the test mode, it becomes possible to automatically adjust the gains A of all the RPI 1 provided for each key of the eighty eight keys 73, thereby increasing the efficiency of gain setting operation. Further, it is possible to perform continual detection of the position of the key 73 with a simple construction consisting of devices such as the RPI 1, VCA circuit 4 as a gain setting means and a microcomputer 10. Even when the reference position for the positional change is not known for certain, so long as the value of the stroke, which is a measure of the relative movement of the key 73, is known, it is possible to correct the gain of each RPI 1 so a to determine the changing position of the keys 73.

Figure 13:
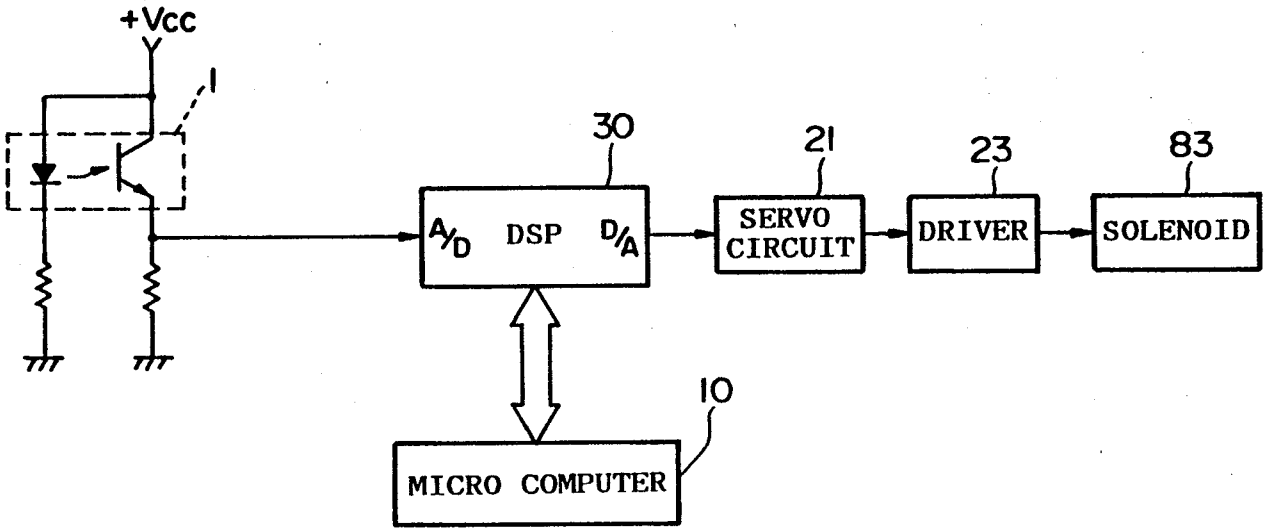
FIG. 13 is a block diagram to for the main components of a second embodiment.
Figure 14:
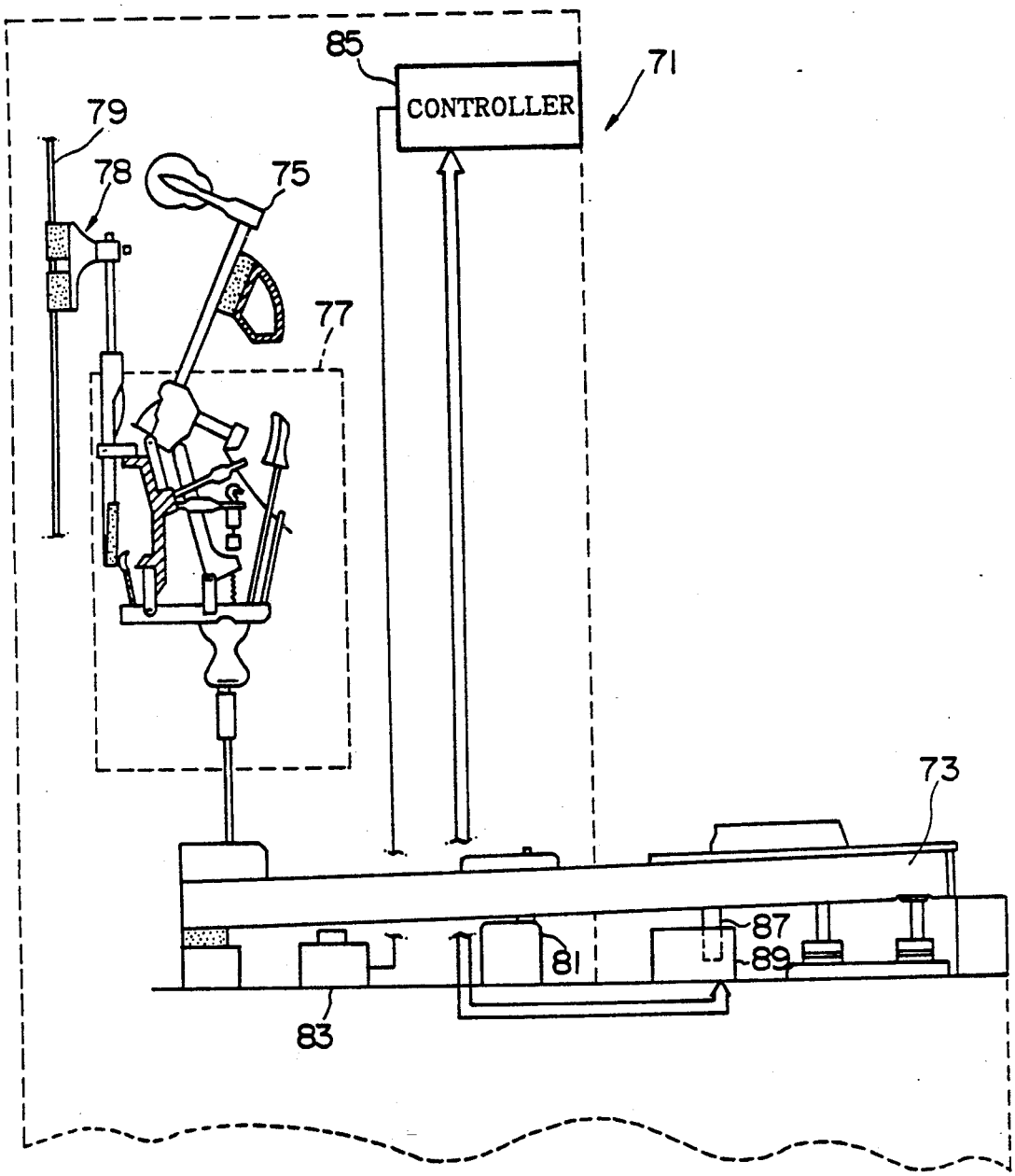
FIG.14 ( PRIOR ART )
FIG. 14 shows a conventional system for determining the key position.

FIG. 13 shows a block diagram for a second preferred embodiment of the present invention. The numeral 30 refers to a digital signal processor (DSP) having an A/D converter at its input terminal and an D/A converter at its output terminal, and is constructed with a dedicated program type processor to enable real time computation. This DSP performs digital computation of the previously described gain adjustments in the VCA circuit 4 (FIG. 1) and the linearization operations in the linearization circuit 6.

Further in the above second embodiment, the process of adjusting the gain of RPI 1 provided as positional detection means for a player piano, but it is possible to apply the system to adjusting the gains of other operative components such as the hammer or damper sensors.

What is claimed is:

1. A key position computing apparatus for a player piano comprising:

(a) sensing means provided on each key for measuring a characteristic operating signal representing a distance between a reference plane and a key surface for each key, and for outputting a value of the characteristic operating signal;

(b) gain adjusting means for adjusting a gain of the value of the characteristic operating signal output from the sensing means to a constant value;

(c) linearizing means for approximating the value of the characteristic operating signal output from the sensing means with a linearized output signal;

(d) memory means for storing computer programs to compute a relationship between the linearized output signal output from the linearizing means and the distance between the reference plane and the key surface;

(e) programmable memory means for storing the value of the characteristic operating signal of the sensing means for each key; and (f) computing means for computing the relationship between the linearized output signal from the linearizing means and the distance from the reference plane to the key surface of each key, thereby permitting a continual monitoring and a real time dynamic reproduction of a musical performance.

2. The key position computing apparatus as claimed in claim 1, wherein the sensing means comprises:

an unitized reflecting type photo-interruptor (RPI) system including a light source for emitting a beam of light to the key surface of each key; and a light sensor for receiving the emitted beam of light reflected from the key surface of each key, and wherein the sensing means further generates a output signal in accordance with a distance x between the reference plane and the key surface of each key.

3. The key position computing apparatus as claimed in claim 2, wherein the RPI system generates an output signal which varies as an exponential function of the distance x.

4. The key position computing apparatus as claimed in claim 1, wherein the gain adjusting means includes a voltage control amplification device which varies an amplification factor in accordance with a signal supplied from an external source.

5. The key position computing apparatus as claimed in claim 1, wherein the linearizing means computes linear tangential expressions to approximate an exponential function.

6. The key position computing apparatus as claimed in claim 1, wherein the computing means and the gain adjusting means comprise an unitized device having a dedicated program which provides a real time digital computation of positional changes exhibited by each key during the musical performance.

7. A method for key position computing for a player piano comprising the steps of:

selecting a first mode for initialization and testing or a second mode for computing a key position;

wherein said first mode comprises the steps of;

(a) generating a reference electrical signal, (b) detecting a reference electrical signal value of the reference electrical signal with a sensor, (c) computing a reference distance using the detected reference signal value according to a distance between a reference plane and a surface of a key, (d) storing the reference electrical signal value detected by the detecting step in a computer memory, and (e) computing a gain of a position computing circuit using a mathematical relationship and the stored reference signal value, and computing a correction factor for the gain of the position computing circuit, wherein said second mode comprises the steps of;

(f) generating and detecting a new reference electrical signal generated according to a new distance between the reference plane and the surface of the key, (g) adjusting the gain of the new reference electrical signal to an adjusted value by the correction factor, (h) linearizing the detected new reference electrical signal to a linearized signal of new distance between the reference plane and the surface of the key.

8. The method of key position computing as claimed in claim 7, wherein the second mode may be repeated without repeating the first mode.

9. The method of key position computing as claimed in claim 7, wherein there is an additional step (d') repeating steps (a) through (d) for a second reference electrical signal according to a second distance between the reference plane and the surface of the key, and wherein step (e) uses both stored values of the reference signals with the mathematical relationship.

10. The method of key position computing as claimed in claim 9, wherein the second mode may be repeated without repeating the first mode.

11. The method of key position computing as claimed in claim 9, wherein the correction factor is stored in the computer memory.

12. The method of key position computing as claimed in claim 7, wherein the first mode is performed automatically.

13. The method of key position computing as claimed in claim 7, wherein the first mode is performed manually.

14. A method for key position computing for a player piano comprising the steps of:

initializing by:

(a) generating a reference electrical signal, (b) detecting a reference electrical signal value of the reference electrical signal with a sensor, (c) computing a reference distance using the detected reference signal value according to a distance between a reference plane and a surface of a key, (d) storing the reference electrical signal value detected by the detecting step in a computer memory, (e) computing a gain of a position computing circuit using a mathematical relationship and the stored reference signal values, and computing a correction factor for the gain of the position computing circuit, and computing a new key position by:

(g) generating a detecting a new reference electrical signal generated according to a new distance between the reference plane and the surface of the key, (h) adjusting the gain of the new reference electrical signal to an adjusted value by the correction factor, (i) computing the new key position using the new reference electrical signal, and (j) linearizing the detected new reference electrical signal to a linearized signal of new distance between the reference plane and the surface of the key.

15. The method of key position computing as claimed in claim 14, wherein there is an additional step (d') repeating steps (a) through (d) for a second reference electrical signal according to a second distance between the reference plane and the surface of the key, and wherein step (e) uses both stored values of the reference signals with the mathematical relationship.

16. The method of key position computing as claimed in claim 15, wherein computing a new key position may be repeated without repeating the initializing steps.

17. The method of key position computing as claimed in claim 15, wherein the correction factor is stored in the computer memory.

18. The method of key position computing as claimed in claim 14, wherein the initializing steps are performed automatically.

19. The method of key position computing as claimed in claim 14, wherein the initializing steps are performed manually.

20. The key position computing apparatus as claimed in claim 3, wherein the linearizing means computes linear tangential expressions to approximate the exponential function.

* * * * *